United States Patent [19]

Perreault

[11] 4,340,773

[45] Jul. 20, 1982

[54] COAXIAL CABLES WITH FOAM DIELECTRIC

[75] Inventor: Aimé J. Perreault, South Burlington, Vt.

[73] Assignee: Champlain Cable Corporation, Wilmington, Del.

[21] Appl. No.: 159,322

[22] Filed: Jun. 13, 1980

[51] Int. Cl.[3] ..... H01B 7/18

[52] U.S. Cl. ..... 174/107; 174/36; 174/102 C; 174/110 F

[58] Field of Search ..... 174/36, 102 C, 110 F, 174/120 SR, 121 SR, 107, 124 R; 428/383, 473.5, 477.7; 156/56

[56] References Cited

U.S. PATENT DOCUMENTS

| | | | |
|---|---|---|---|
| 455,904 | 7/1891 | McCracken | 174/124 R |
| 3,193,426 | 7/1965 | Schafer | 174/110 F |
| 3,309,458 | 3/1967 | Yoshimura . | |
| 3,573,976 | 4/1971 | Duane . | |
| 3,591,562 | 7/1971 | Patton | 528/44 |
| 3,681,515 | 8/1972 | Mildner | 174/36 X |
| 3,745,232 | 7/1973 | Johnson | 174/107 |
| 3,968,463 | 8/1976 | Boysen . | |
| 4,107,354 | 8/1978 | Wilkenloh . | |
| 4,161,564 | 7/1979 | Legbandt | 428/383 |

OTHER PUBLICATIONS

Anaconda Sealmatic Design, The New Coaxial Cable Line for Cat V, Brochure of Anaconda 1966, pp. 1, 2.

Mitchell, Dual, "Insulation Conserves Cable Materials", Bellab Record, vol. 54 #8, pp. 225-228, 9/76.

*Primary Examiner*—Elliot A. Goldberg

*Attorney, Agent, or Firm*—Joshua W. Martin, III

[57] ABSTRACT

A dielectric system for coaxial electrical conductors is provided. The dielectric system separates an inner and an outer conductor and is composed of a first layer of cellular polyparabanic acid. This layer directly contacts and provides a continuous skin circumferentially surrounding the inner conductor along its length. A second layer, consisting of a crosslinkable polymeric lacquer which provides a continuous skin enclosing the first layer is also provided. The dielectric system is used in coax cables.

3 Claims, 1 Drawing Figure

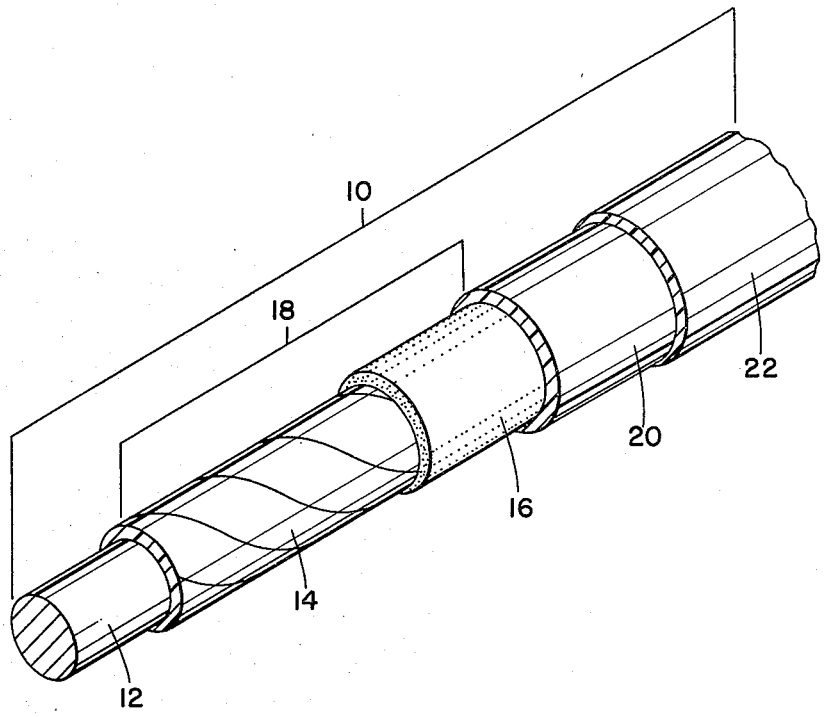
10
18
22
20
16
14
12

COAXIAL CABLES WITH FOAM DIELECTRIC

SUMMARY OF THE INVENTION

The present invention relates to a dielectric system for use in a coaxial cable. In particular, the present invention relates to a dielectric system for coaxial electrical conductors which separates an inner and an outer conductive material and which comprises a first layer of cellular polyparabanic acid providing a continuous skin directly contacting and surrounding said inner conductor along its length and a second layer consisting of a crosslinkable polymeric lacquer, said second layer providing a continuous skin enclosing the first layer.

BACKGROUND OF THE INVENTION

A coaxial cable is usually comprised of an inner conductive member, a dielectric system surrounding the inner conductor, and an outer conductive member coaxially surrounding the dielectric system. The inner conductive member and the outer conductive members are made with some appropriate metal, most commonly copper, aluminum or some alloy containing such metal. The dielectric system is usually composed of some suitable plastic, and use of polyethylene, polystyrene, and polypropylene, in expanded or unexpanded form, is common.

The best dielectric, from a theoretical standpoint, would be a layer of air, which has a dielectric constant of 1.0. It is virtually impossible to construct such a cable, however, and commercial cables employ solid materials with necessarily higher dielectric constants. The higher the dielectric constant of the material, the lower the velocity of propagation of the coaxial cable as a whole, and thus, the longer the cable will take to transmit an electrical signal along its length. In addition to improved velocity of propagation, a lower dielectric constant will allow a thinner insulation layer which should produce a smaller finished cable diameter. This becomes important in applications which have space or weight limitations.

One method which has been followed in attempting to increase the velocity of propagation of a cable has been to decrease the effective dielectric constant by introducing air or other materials into an otherwise solid dielectric layer.

In U.S. Pat. No. 3,309,458, a coaxial conductor is shown which employs as a dielectric a two-layer system. The first layer of the system is comprised of a brittle foamed synthetic resin and the second layer is composed of a nonfoamed synthetic resin which is pliable in comparison with the foamed resin.

In U.S. Pat. No. 3,573,976, a coaxial cable is provided in which the dielectric is extruded from a combination of glass, silica or ceramic microspheres; a suspension of powdered polyethylene or polymeric fluorocarbon resin; a volatile ethylene dichloride or trichloroethylene carrier and a tackifying agent of polyisobutylene or hexafluoropropylenevinylidene fluoride copolymer. The microspheres, or microballoons as they are also known, are discrete, hollow, spherical particles, and the effective dielectric constant of the dielectric system is reduced according to the amount of air encapsulated therein.

U.S. Pat. No. 3,968,463 discloses a coaxial cable having as a dielectric coating on the core conductor, an extruded cellular ethylene or propylene polymer based composition.

U.S. Pat. No. 4,107,354 is directed to a method of forming a coaxial cable by coating a center conductor of the cable with a dielectric composed of cellular polyolefin.

The problem which has been encountered with coaxial cables employing foamed dielectric systems is that as the amount of foaming, and therefore the amount of encapsulated air, is increased, the mechanical and heat resistance properties of the cable are adversely affected. To provide sufficient mechanical strength, cables must have diminished flexibility or increased size, and this limits the applications for which the cable may be used.

Another method used to incorporate air into the dielectric system has been through the use of disk type insulating separators. Following this method, disk type insulating separators of a material such as polyethylene are fitted onto an inner conductor at spaced intervals, thereby leaving air filled interstitial spaces. Such construction, however, lacks mechanical strength, particularly when the coaxial cable is bent, and the cables must be handled with great care.

It is an object of the present invention to provide a dielectric system for a coaxial cable which has a low effective dielectric constant.

It is a further object of the present invention to provide a dielectric system for a coaxial cable which has a low effective dielectric constant, but which has sufficient mechanical strength to allow substantial flexibility in the finished cable.

It is still a further object of the present invention to provide a dielectric system for a coaxial cable which has a low effective dielectric constant, but which has sufficient mechanical strength over a substantial range of temperatures to allow the construction of cables of very small diameter with consistent and predictable electric characteristics, which are particularly useful in applications which call for miniaturized electrical conductors.

The foregoing, as well as other objects, features, and advantages of the present invention are pointed out with particularity in the claim annexed to this specification. Further, they will become more apparent in light of the following detailed description of the preferred embodiment thereof and as illustrated in the accompanying drawings.

According to the present invention, there is provided a dielectric system for coaxial electrical conductors which separates an inner and outer conductive material. The dielectric system of the present invention comprises a first layer of cellular polyparabanic acid providing a continuous skin directly contacting and surrounding said inner conductor along its length and a second layer consisting of a crosslinkable polymeric lacquer, said second layer providing a continuous skin enclosing the first layer.

BRIEF DESCRIPTION OF THE DRAWING

The drawing shows a segment of a coaxial cable with the dielectric system of the present invention, having the various layers cut away for the purposes of illustration.

DETAILED DESCRIPTION OF THE PREFERRED EMBODIMENT

A typical coaxial conductor employing the dielectric system (18) of the present invention is shown in the drawing. The coaxial cable (10) has been cut away to show its various layers. An inner metallic conductor (12), sometimes referred to as a core, is shown as the central element, and is surrounded circumferentially by the dielectric system (18) of the present invention. This conductor (12) may be constructed of copper or aluminum or some appropriate alloy, and may be in the form of a solid wire or a plurality of individual metallic strands wound together.

This inner conductor (12) is surrounded circumferentially by a first layer of cellular polyparabanic acid (14). The present invention contemplates the application of this layer in the form of a continuous tape wrapped circumferentially around the inner conductive member (12) by means well known to the art. However, the present invention is not meant to be limited to the application of this layer (14) by this method, and the layer (14) may be applied by other methods known to the art.

A continuous layer of crosslinkable polymeric lacquer (16) circumferentially surrounds the polyparabanic acid layer (14) and acts both as an adhesive, holding the inner layers in place, and as a sealant. This layer (16) represents the outermost layer of the dielectric system (18) of the present invention and may be applied by a dip coating technique or by other means known to the art.

To complete the cable, an outer conductor (20), which may be woven or solid, is disposed circumferentially about the dielectric system (18) of the present invention and said outer conductor (20) is typically surrounded circumferentially by a compatible protective layer (22) of a type well known to the art.

EXAMPLE 1

A small diameter coaxial cable for use in an application requiring a miniature coaxial cable was fabricated with the dielectric system of the present invention in the following manner. A 30 AWG solid copper conductor with a 0.010 inch diameter was used as a central conductive member. Cellular polyparabanic acid acid, commercially available from Exxon under the Trademark Tradlon®, was applied in the form of a tape, measuring 0.006 inch in thickness and 0.062 inch in width. The tape was applied on an EJR Enginering tape-wrapping machine which is capable of providing accurate tension control, with a sufficient overlap, approximately 25%, to avoid separation when the tape is bent and yet still maintain a small diameter in the dielectric system.

Over the cellular polyparabanic acid layer thus applied, an acrylic topcoat layer was applied which acts as an adhesive and sealant. In this example, a thin coating of liquid methyl methacrylate containing a self-contained crosslinking agent, commercially available from the Rohm and Haas Company under the Trademark Rhoplex AC-1230, was applied using a dip flow coating technique known to the art, and cured in a wire enameling oven. An outer conductive member and a protective layer of polymeric fluorocarbon were applied in a manner well known to the art. The resulting cable had a characteristic impedance of 50 ohms and demonstrated the following useful properties, which did not deteriorate with substantial handling or flexing and exposure to a wide temperature range.

Electrical

Velocity of propagation: 80–83% (of the speed of light).

Capacitance: approximately 24 picofarads per foot.

Other

Finished cable diameter: less than 0.062 inch.

Maximum continuous operating temperature: 150° C.

Flexibility and mechanical strength: very good.

Solder bath test (230° C.–15 sec.): no effect.

EXAMPLE 2

A small diameter coaxial cable was fabricated according to the method described in Example 1. A 30 AWG member comprised of seven copper strands and having a combined diameter of 0.012 inch was used as a central conductive member. Cellular polyparabanic acid, of the same type used in Example 1, was applied in the form of a tape measuring 0.009 inch in thickness and 0.062 inch in width following the teachings of Example 1. An acrylic topcoat layer of the same material used in Example 1 was applied in the same manner as described therein. Following this, an outer conductive member and a protective layer were applied in a manner well known to the art.

The resulting cable had a characteristic impedance of 75 ohms and demonstrated useful dielectric properties.

EXAMPLE 3

A small diameter coaxial cable was fabricated according to the method described in Example 1. A 32 AWG solid copper member having an 0.008 inch diameter was used as a central conductive member. Cellular polyparabanic acid, of the same type used in Example 1, was applied in the form of a tape measuring 0.010 inch in thickness and 0.062 inch in width following the teachings of Example 1. An acrylic topcoat layer of the same material used in Example 1 was applied in the same manner as described therein. Following this, an outer conductive member and a protective layer were applied in a manner well known to the art.

The resulting cable had a characteristic impedance of 90 ohms and demonstrated useful dielectric properties.

What I claim and desire to protect by Letters Patent is:

1. A coaxial cable comprising:
   a. an inner conductor;
   b. a dielectric system surrounding said inner conductor, said dielectric system comprising:
      (i) a first layer of cellular polyparabanic acid providing a continuous skin directly contacting and surrounding said inner conductor along its length, and
      (ii) a second layer consisting of a crosslinkable polymeric lacquer providing a continuous skin enclosing the first layer;
   c. an outer conductor disposed circumferentially about the dielectric system;
   d. an outer protective layer surrounding circumferentially the outer conductor.

2. The coaxial cable of claim 1 in which the first layer of cellular polyparabanic acid is in the form of a continuous tape wrapped about the inner conductor.

3. The coaxial cable of claim 2 in which the tape is wrapped about the inner conductor in an overlapping arrangement such that approximately 25% of the tape of one layer overlaps an adjacent layer.

* * * * *